US006586375B1

(12) United States Patent
Gahagan et al.

(10) Patent No.: US 6,586,375 B1
(45) Date of Patent: Jul. 1, 2003

(54) PHOSPHORUS SALTS OF NITROGEN CONTAINING COPOLYMERS AND LUBRICANTS CONTAINING THE SAME

(75) Inventors: Michael P. Gahagan, Derby (GB); Matthew R. Sivik, Broadview Hts., OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/122,554

(22) Filed: Apr. 15, 2002

(51) Int. Cl.[7] ..... C10M 141/06; C10M 141/10

(52) U.S. Cl. ..... 508/244; 508/264; 508/268; 508/297; 508/436

(58) Field of Search ..... 508/244, 264, 508/268, 297, 436

(56) References Cited

U.S. PATENT DOCUMENTS

| | | | | | |
|---|---|---|---|---|---|
| 3,197,405 | A | | 7/1965 | LeSuer | 252/32.7 |
| 3,544,365 | A | | 12/1970 | Braid | 252/46.6 |
| 4,490,267 | A | * | 12/1984 | Eckert | 508/264 |
| 4,664,823 | A | * | 5/1987 | Kuwamoto et al. | 508/190 |
| 4,666,617 | A | * | 5/1987 | Katayama et al. | 508/436 |
| 4,755,311 | A | | 7/1988 | Burjes et al. | 252/49.9 |
| 4,800,034 | A | * | 1/1989 | Akao et al. | 508/262 |
| 5,188,770 | A | * | 2/1993 | Pennewiss | 508/471 |
| 5,298,565 | A | * | 3/1994 | Lange et al. | 525/279 |
| 5,883,057 | A | | 3/1999 | Roell, Jr. et al. | 508/469 |

FOREIGN PATENT DOCUMENTS

WO WO87/07638 12/1987

OTHER PUBLICATIONS

C.V. Smalheer and R.K. Smith, "Lubricant Additives", The Lezius–Hiles Co. (1967).

M.W. Ranney, "Lubricant Additives, Recent Developments", Noyes Data Corp. (1978) pp. 139–164.

M.W. Ranney, "Synthetic Oils and Additives for Lubricants", Noyes Data Corp. (1980) pp. 96–166.

* cited by examiner

*Primary Examiner*—Jacqueline V. Howard
(74) *Attorney, Agent, or Firm*—Teresan W. Gilbert; Michael F. Esposito

(57) ABSTRACT

This invention relates to a lubricating composition comprising a major amount of an oil of lubricating viscosity and a minor amount of a salt of at least one nitrogen containing polyacrylate and at least one phosphorus acid ester. The invention also relates to lubricating compositions and concentrates containing the same. The present phosphorus salts of the nitrogen containing copolymers provide improved dispersant, viscosity improver and antiwear properties to lubricating compositions.

10 Claims, No Drawings

PHOSPHORUS SALTS OF NITROGEN CONTAINING COPOLYMERS AND LUBRICANTS CONTAINING THE SAME

TECHNICAL FIELD OF THE INVENTION

This invention relates to phosphorus salts of dispersant viscosity improvers and lubricating compositions and concentrates containing such salts.

BACKGROUND OF THE INVENTION

Dispersant viscosity improvers are used in lubricating compositions to control the viscosity decrease of the lubricating oils under increasing temperatures. Additionally, these materials have components which improve the oil's ability to suspend or "disperse" impurities in the oil. The dispersing of the impurities prevents them from depositing on the surface of lubricated parts. Polyacrylates, especially polymethacrylate ester polymers, are well known and widely used as viscosity improvers. When these materials have a nitrogen containing monomer, they act as a multifunctional additives providing viscosity improving properties as well as dispersant properties to the lubricating compositions.

Multifunctional additives that provide both viscosity improving properties and dispersant properties are known in the art. Such products are described in numerous publications including C. V. Smalheer and R. K. Smith "Lubricant Additives", Lezius-Hiles Co. (1967); M. W. Ranney, "Lubricant Additives, Recent Developments", Noyes Data Corp (1978), pp 139–164; and M. W. Ranney, "Synthetic Oils and Additives for Lubricants", Noyes Data Corp. (1980), pp 96–166. Each of these publications is hereby expressly incorporated herein by reference.

Phosphorus containing antiwear agents have been used to prevent adverse wear to metal surfaces of equipment. The phosphorus antiwear agents act to help prevent adverse metal to metal contact.

It is desirable to have a multifunctional additive that provides the benefits of the dispersant viscosity improvers as well as the phosphorus containing antiwear agents.

SUMMARY OF THE INVENTION

This invention relates to a lubricating composition comprising a major amount of an oil of lubricating viscosity and a minor amount of a salt of at least one nitrogen containing polyacrylate and at least one phosphorus acid ester. The invention also relates to lubricating compositions and concentrates containing the same. The present phosphorus salts of the nitrogen containing copolymers provide improved dispersant, viscosity improver and antiwear properties to lubricating compositions. In particular, the salts provide improved viscosity temperature characteristics in finished fluids. The salts also provide improved thermal stability of the lubricating compositions.

DETAILED DESCRIPTION OF THE INVENTION

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

As used herein, the terms "acrylate" and "acrylamide" includes their alkyl substituted versions, such as lower alkyl acrylates and lower alkyl acrylamides, and especially, methacrylates and methacrylamides. Lower alkyl refers to groups containing 8 or less carbon atoms.

The nitrogen-containing polymers of this invention may be prepared by several different processes. In one embodiment, the nitrogen-containing polymer is obtained by reacting, together, the acrylate ester monomers and the nitrogen-containing monomer. In another embodiment, the nitrogen-containing monomer is grafted onto a preformed acrylate copolymer backbone.

The nitrogen containing polymers generally have weight average molecular weight (Mw) ranging from about 10,000 to about 350,000 or from about 12,000 to about 200,000 or from about 15,000 to about 150,000 or from about 20,000 to about 120,000. Here and elsewhere in the specification and claims range and ratio limits may be combined. Polydispersity of the nitrogen containing polymers (abbreviated PDI for polydispersity index) values (Mw/Mn), where Mn denotes number average molecular weight, range from about 1.2 to about 5, or from about 2 to about 4.

Molecular weights of polymers are determined using well-known methods described in the literature. Examples of procedures for determining molecular weights are gel permeation chromatography (also known as size-exclusion chromatography) and vapor phase osmometry.

The nitrogen containing polymers of the present invention are derived from a majority of acrylate ester monomers. In one embodiment, the ester groups of the acrylate monomers independently contain from about 1 to about 30 carbon atoms, or from about 4 to about 24 carbon atoms. The acrylate monomers are generally derived by esterifying acrylic or methacrylic acid with one or more alcohols. Useful alcohols include methyl alcohol, ethyl alcohol, butyl alcohol, octyl alcohol, iso-octyl alcohol, isodecyl alcohol, undecyl alcohol, dodecyl alcohol, tridecyl alcohol, capryl alcohol, lauryl alcohol, myristyl alcohol, pentadecyl alcohol, palmityl alcohol, stearyl alcohol and the like. The additional alcohols and the acrylate monomers derived therefrom may be used to make the majority of the polymer. These monomers may be used alone or in combination. The alcohols may be reacted with acrylic acid or methacrylic acid to form the desirable acrylates or methacrylates.

The acrylate ester monomers can be prepared by conventional methods well-known to those of skill in the art.

In one embodiment, the nitrogen-containing polymers are derived from (a) from about 5% to about 75% by weight, or from about 30% to about 60% by weight of alkyl acrylate ester monomers containing from 1 to 11 carbon atoms in the alkyl group and (b) from about 25% to about 95% by weight, or from about 40% to about 70% by weight of alkyl acrylate ester monomers containing from 12 to about 24 carbon atoms in the alkyl group. Alkyl methacrylate esters are particularly useful monomers. In another embodiment, monomer (a) comprises at least 5% by weight of alkyl acrylate esters having from 4 to 11 carbon atoms in the alkyl group. In another embodiment, monomer (a) comprises from about 10% to about 40% by weight alkyl acrylate esters having from 1 to 4 carbon atoms in the alkyl group. In still another embodiment, monomer (a) comprises from about 60% to about 90% by weight of alkyl acrylate esters having from 9 to 11 carbon atoms in the alkyl group.

In another embodiment, the nitrogen containing polymers are derived from a mixture of alkyl methacrylate ester monomers containing, (a) from about 9 to about 25 carbon atoms in the ester group, or from about 13 to about 19 carbon atoms, or to about 16 carbon atoms, and (b) from about 7 to about 12 carbon atoms in the ester group, or from about 9 to about 12 carbon atoms, or 9 carbon atoms. In one embodiment, the polymer is derived from ester (a) and (b) and at least one monomer selected from the group consisting of methacrylic acid esters containing from 2 to about 8 carbon in the ester group atoms and which are different from methacrylic acid esters (a) and (b). Typically, the mole ratio of esters (a) to esters (b) in the copolymer ranges from about 95:5 to about 35:65, often from about 90:10 to about 60:40, and frequently from about 80:20 to about 50:50. In one embodiment, ester (b) are branched.

As noted herein above, the ester alkyl group is generally derived from an alcohol. Alcohols which are useful for preparing ester (a) contain from about 8 to about 24 carbon atoms, or from about 12 to about 15 carbon atoms. Mixtures of alcohols are commercially available and are frequently useful. The alcohols used to prepare ester (a) may be linear or branched. In one embodiment, from about 2 to about 65% of the alcohols are branched, frequently from about 5 to about 60% are branched. Examples of alcohols useful to prepare ester (a) include n-octanol, n-decanol, n- and branched-C12, C15, C16, and C22 alcohols, mixtures of alcohols, e.g., C12–15 alcohols available under the tradenames Dobanol 25, Neodol 25, Lial 125, and Alchem 125, which have varying degrees of branching, for example from about 5% to about 50% branching, or even more, and Alfol 1214, which is substantially linear. In one embodiment, the ester groups in ester (a) contain branched alkyl groups. Often from about 2 to about 65%, frequently from about 5 to about 60% of the ester groups contain branched alkyl groups.

Alcohols which are useful for preparing ester (b) contain from 6 to about 11 carbon atoms, or from 8 to about 11, or 8 carbon atoms. These alcohols have a 2-(C1–4 alkyl) substituent, namely, methyl, ethyl, or any isomer of propyl and butyl. Examples of alcohols useful for preparing ester (b) include 2-methylheptanol, 2-methyldecanol, 2-ethylpentanol, 2-ethylhexanol, 2-ethyl nonanol, 2-propyl heptanol, -2-butyl heptanol, etc. Especially useful is 2-ethylhexanol. As noted, the ester (b) has 2-(C1–4 alkyl)-substituents. The C1–4 alkyl substituents may be methyl, ethyl, and any isomers of propyl and butyl. A useful 2-alkyl substituent is ethyl.

(C) The Nitrogen-Containing Monomer

The nitrogen-containing polymers of this invention are derived from a nitrogen containing monomer. Typically the nitrogen containing monomers are present in an amount from about 0.1% to about 20%, or from about 0.5% to about 5% by weight, or from about 1.5% to about 2.5% by weight. In one embodiment, the nitrogen containing monomer is present in an amount from about 0.2, often from about 1 mole %, up to about 20 mole %, more often up to about 8 mole %, of groups derived from monomer (c).

The nitrogen containing monomer may be any monomer that is capable of copolymerizing with acrylate monomers or is capable of being grafted onto polyacrylate polymers. The nitrogen containing monomers include vinyl substituted nitrogen heterocyclic monomers, dialkylaminoalkyl acrylate monomers, dialkylaminoalkyl acrylamide monomers, tertiary-acrylamides and the like.

Useful nitrogen containing monomers include vinyl substituted nitrogen heterocyclic monomers, for example vinyl pyridine and N-vinyl-substituted nitrogen heterocyclic monomers, for example, N-vinyl imidazole, N-vinyl pyrrolidinone, and N-vinyl, caprolactam; dialkylaminoalkyl acrylate and methacrylate monomers, for example N,N-dialkylaminoalkyl acrylates, dimethylaminoethyl methacrylate or dimethylamine propyl methacrylate; dialkylaminoalkyl acrylamide and methacrylamide monomers, for example di-lower alkylaminoalkylacrylamide, especially where each alkyl or aminoalkyl group contains from 1 to about 8, or from 1 to 3 carbon atoms, for example N,N-di lower alkyl, especially, dimethylaminopropylacrylamide; N-tertiary alkyl acrylamides and corresponding methacrylamides, for example tertiary butyl acrylamide, vinyl substituted amines and the like.

The nitrogen containing polymers of may be prepared in the presence of a diluent. A diluent may also be added to a substantially diluent-free copolymer, usually by dissolving or dispersing the substantially diluent-free polymer in an appropriate diluent. In one embodiment, the diluent is a mineral oil, such as, for example, hydrotreated naphthenic oil, or a synthetic oil, such as ester type oils, polyolefin oligomers or alkylated benzenes. Useful diluents are naphthenic oils, hydrotreated naphthenic oils, and alkylated aromatics, particularly alkylated benzenes having at least one alkyl group containing from about 8 to about 24 carbon atoms, or from 12 to about 18 carbon atoms. Especially useful are hydrotreated naphthenic oils, examples being Risella G-07, Cross Oil Co.'s L-40, a 40 neutral hydrotreated naphthenic oil and L-60, which is a 60 neutral oil.

The diluent-containing polymers are referred to herein as additive concentrates. Such additive concentrates are then added, along with other desirable performance-improving additives, to an oil of lubricating viscosity to prepare the finished lubricant composition. In one embodiment, the additive concentrates comprise from about 25% to about 90% by weight of copolymer, or from 35% to about 80% by weight, and from about 10% to about 75% by weight of diluent, or from about 20% to about 65% by weight of diluent.

The copolymers of this invention may be prepared by several different techniques. In one embodiment, the acrylate ester monomers and nitrogen-containing monomer are reacted together. In another embodiment, the acrylate esters are reacted to form an acrylate ester copolymer backbone onto which is grafted a nitrogen-containing monomer. In still another embodiment, a mixture of acrylate and nitrogen-containing monomers may be grafted onto a preformed acrylate ester polymer backbone.

In the first embodiment, a mixture of monomers is charged to a reactor together with, if desired, diluent and again, if desired, chain transfer agent. The materials are stirred under a nitrogen atmosphere. Subsequently, a polymerization initiator is added and the materials are heated to reaction temperature. The reaction is continued until the desired degree of polymerization is attained.

In an alternative embodiment, the monomers are polymerized incrementally. A mixture of monomers together with a polymerization initiator is prepared. A portion, typically about 20% to about 40%, more often about 33%, of the mixture, is charged to a reactor with the balance being placed in an addition vessel. The reactants are heated under a nitrogen atmosphere until an exothermic reaction is noted. When the exothermic reaction begins to subside, addition of the balance of the monomer-initiator mixture is begun, while maintaining, via heating or cooling, as needed, the desired reaction temperature.

In the second embodiment, the acrylate monomers are polymerized, then the grafting of the nitrogen-containing monomer onto the preformed acrylate ester copolymer is accomplished. A mixture of additional acrylate monomers together with nitrogen-containing monomer may be grafted onto the preformed acrylate ester polymer.

The entire charge of the nitrogen containing monomer may be present at the start of the polymerization process. Alternatively, the nitrogen containing monomer may be added to the already prepared polyacrylate either gradually or incrementally. In the grafting process, additional initiator is usually employed during the grafting step. In either process, additional initiators may be added during processing.

Polymerization can take place under a variety of conditions, among which are bulk polymerization, solution polymerization, emulsion polymerization, suspension polymerization and nonaqueous dispersion techniques.

To prepare the copolymers constituting the dispersant viscosity improvers in accordance with the invention it is possible to make use of the conventional methods of radical copolymerization. These methods include free-radical initiated polymerization employing azo compounds or peroxides, photochemical and radiation initiated methods. Molecular weights of the polymers can be controlled employing a number of techniques including choice of initiator, reaction temperature, concentration of monomers and solvent type. Chain transfer agents can also be used. The products of the present invention are generally prepared at temperatures ranging from about 60° C. to about 140° C., or from about 80° C. to about 120° C.

Another useful means for preparing the copolymers of this invention is to employ known in the art high energy mechanical mixing devices. These include roll mills, ball mills or extruders. Of these, extruders are preferred since the comonomers can be fed to the feed hopper in any desired fashion.

The following examples are intended to illustrate several compositions of this invention as well as means for preparing same. Unless indicated otherwise all parts are parts by weight. It is to be understood that these examples are intended to illustrate several compositions and procedures of the invention and are not intended to limit the scope of the invention. Molecular weight values are determined employing gel permeation chromatography (GPC) employing well-characterized polymethacrylate (PMA) calibration standards.

EXAMPLE N-1

A container is charged with 33.9 parts methyl methacrylate, 7.5 parts butyl methacrylate, 133.6 parts C9–C11 methacrylate, 133.6 parts C12–C15 methacrylate, 67.7 parts C16–C18 methacrylate, 13.65 parts N-vinyl pyrrolidinone (NVP) and 130 parts Risella G 07 oil. The materials are stirred for 0.25 hour, then a solution of 1.56 part VAZO-67 in 3.1 parts toluene is added followed by stirring for 0.1 hour. A reactor equipped with a stirrer, thermocouple, nitrogen inlet atop an addition funnel attached to a subsurface tube, and water condenser is charged with about ⅓ of this solution; the remainder is placed in the addition funnel. With stirring and N2 addition at 0.3 SCFH, the mixture is heated to 110° C. over 0.3 hour, heating is stopped and the temperature rises exothermically to 138° C. over 3 minutes. The temperature then begins to drop and after 2 minutes is at 136° C. Dropwise addition of the remaining monomer-initiator mixture is begun and is continued for 2 hours. Temperature decreases to 110° C. after 0.3 hours and is held at 110° C. during addition. After addition is completed, the mixture is cooled to 90° C. over 0.3 hour followed by charging 0.25 part Trigonox 21. The materials are stirred at 90° C. for 2 hours, 0.26 part Trigonox 21 is charged and the materials are heated for an additional 2 hours. The materials are diluted with 80 parts additional Risela G 07 oil, heated with stirring to 150° C., and stripped at 150° C., 40–50 mm Hg pressure for 1 hour, collecting 1 part distillate. The residue is filtered at 110° C. with a diatomaceous earth filter aid. The filtrate contains a polymer having Mn=68,000 and Mw/Mn=2.91.

EXAMPLE N-2

The procedure of Example 1 is substantially followed replacing NVP with 17.3 parts N-vinyl caprolactam. The product has Mn=72,800 and Mw/Mn=3.06.

EXAMPLE N-3

The procedure of Example 11 is substantially followed replacing NVP with 20.9 parts N,N-dimethylaminopropyl methacrylamide. The product has Mn=45,400 and Mw/Mn=2.64.

EXAMPLE N-4

A vessel is charged with 272.8 parts C12–15 methacrylate, 120 parts 2-ethylhexyl methacrylate, 100 parts mineral oil (Total 85N), and 7.6 parts each Trigonox 21 and t-dodecyl mercaptan. The materials are stirred for 0.25 hour, then about ⅓ of the mixture and 7.2 parts dimethylaminopropyl methacrylamide are charged to a reactor equipped with a stirrer, thermocouple, N2 inlet with addition funnel and condenser. The remaining ⅔ of the mixture is placed in the addition funnel. The mixture in the flask is heated to 110° C. under N2, over 0.2 hour whereupon an exotherm ensues with an increase in temperature to 144° C. After about 0.1 hour the temperature is 140° C. and addition of the mixture from the addition funnel is begun @ 4.4 ml/hour. Within 0.2 hour the temperature is 110° C. The addition is continued for 1.5 hours, maintaining temperature at 107–114° C. Heating is continued for 3 hours at about 110° C., 0.4 part additional Trigonox 21 is added and after an additional 2.5 hours at about 110° C., the infrared spectrum indicated the reaction is completed. The batch is stripped to 150° C. and 12 mm Hg, cooled to 85° C. and filtered twice through a Buchner funnel employing filter aid. The filtrate has Mw=50,018, Mn=14,618 and PDI=3.42.

EXAMPLE N-5

A vessel is charged with 272.8 parts C12–15 methacrylate, 120 parts 2-ethylhexyl methacrylate, 100 parts mineral oil (Total 85N), and 5 parts each Trigonox 21 and t-dodecyl mercaptan. The materials are stirred for 0.25 hour, then about ⅓ of the mixture and 7.2 parts dimethylaminopropyl methacrylamide are charged to a reactor equipped with a stirrer, thermocouple, N2 inlet with addition funnel and condenser. The remaining ⅔ of the mixture is placed in the addition funnel. The mixture in the flask is heated to 110° C. under N2, over 0.2 hour whereupon an exotherm ensues with an increase in temperature to 141° C. After the exotherm subsides (1 minute) the temperature is 140° C. Addition of the remaining monomer mixture is begun and is continued over 1.5 hours, while the temperature range is maintained at 108–112° C. After heating at 108–110° C. for 3 hours, 0.5 part additional Trigonox 21 is added and heating at 110° C. is continued for 2 hours, then materials are stripped to 135° C. at 50 mm Hg. The residue is mixed with 37.6 parts additional oil. The product has Mw=59,201, Mn=24,232 and PDI=2.44.

EXAMPLE N-6

A vessel is charged with 3601 parts C12–15 methacrylate, 1584 parts 2-ethylhexyl methacrylate, 1280 parts Total 85N, and 40 parts each 150N mineral oil, Trigonox 21 and t-dodecyl mercaptan. The materials are stirred for 0.25 hour, then about ⅓ of the mixture and 95 parts dimethylaminopropyl methacrylamide are charged to a reactor equipped with a stirrer, thermocouple, N2 inlet with addition funnel and condenser. The remaining ⅔ of the mixture is placed in the addition funnel. The mixture in the flask is heated to 110° C. under N2, over 0.4 hour whereupon an exotherm ensues with an increase in temperature to 149° C. After the exotherm subsides (3 minutes) the temperature is 148° C. Addition of the remaining monomer mixture is begun and is continued over 1.6 hours while the temperature returns to and is maintained at a temperature of 108–113° C. After heating at 113° C. for 2.5 hours, infra-red spectrum indicates polymerization is not quite complete; 2.5 part additional Trigonox 21 is added and heating at 110° C. is continued for 2 hours, with infra-red showing reaction is complete. Materials are stripped to 120° C. at 50 mm Hg. The residue is mixed with 503 parts additional Total 85N. The product has Mw=61,074, Mn=27,521 and PDI=2.22.

Phosphorus Acid Ester

As described above, the present invention relates to salts of nitrogen containing polymers. The salts of phosphorus salts prepared from phosphoric acid esters. The salts are prepared by mixing enough phosphorus acid ester to neutralize at least all or a portion of the basic nitrogen present in the nitrogen containing copolymer. The mixture typically comprises from about 0.5 parts to about 10 parts, or from about 1 part to about 8 parts or from about 2 parts to about 6 parts by weight of phosphorus acid ester to about 99.5 parts to 90 parts, or from 99 parts, to 93 parts, or from 98 parts to 94 parts by weight nitrogen containing polymer.

In one embodiment, the phosphorus acid ester is a phosphorus acid ester prepared by reacting one or more phosphorus acids or anhydrides with an alcohol containing from one, or from about 3 carbon atoms. The alcohol generally contains up to about 30, or up to about 24, or up to about 12 carbon atoms. The phosphorus acid or anhydride is generally an inorganic phosphorus reagent, such as phosphorus pentoxide, phosphorus trioxide, phosphorus tetroxide, phosphorus acid, phosphorus halide, lower phosphorus esters, or a phosphorus sulfide, including phosphorus pentasulfide, and the like. Examples of phosphorus acids or anhydrides include phosphorus pentoxide, phosphorus pentasulfide and phosphorus trichloride. Lower phosphorus acid esters generally contain from 1 to about 7 carbon atoms in each ester group. The phosphorus acid ester may be a mono-, di- or triphosphoric acid ester. Alcohols used to prepare the phosphorus acid esters include butyl, amyl, 2-ethylhexyl, hexyl, octyl, oleyl, and cresol alcohols. Examples of commercially available alcohols include Alfol 810; Alfol 1218; Alfol 20+ alcohols; and Alfol 22+ alcohols. Alfol alcohols are available from Continental Oil Company. Another example of a commercially available alcohol mixtures are Adol 60 and Adol 320. The Adol alcohols are marketed by Ashland Chemical.

A variety of mixtures of monohydric fatty alcohols derived from naturally occurring triglycerides and ranging in chain length of from about $C_8$ to $C_{18}$ are available from Procter & Gamble Company. These mixtures contain various amounts of fatty alcohols containing mainly 12, 14, 16, or 18 carbon atoms. An example is CO-1214 fatty alcohol. Another group of commercially available mixtures include the "Neodol" products available from Shell Chemical Co. Examples include Neodol 91 alcohols; Neodol 23 alcohols; Neodol 25 alcohols; and Neodol 45 alcohols.

Examples of useful phosphorus acid esters include the phosphoric acid esters prepared by reacting a phosphoric acid or anhydride with cresol alcohols. An example of these phosphorus acid esters is tricresylphosphate.

In another embodiment, the phosphorus antiwear/extreme pressure agent is a thiophosphorus acid ester or salt thereof. The thiophosphorus acid ester may be prepared by reacting a phosphorus sulfide, such as those described above, with an alcohol, such as those described above. The thiophosphorus acid esters may be mono- or dithiophosphorus acid esters. Thiophosphorus acid esters are also referred to generally as thiophosphoric acids.

In one embodiment, the phosphorus acid ester is a monothiophosphoric acid ester or a monothiophosphate. Monothiophosphates may be prepared by the reaction of a sulfur source with a dihydrocarbyl phosphite. The sulfur source may for instance be elemental sulfur. The sulfur source may also be a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, the phosphorus antiwear/extreme pressure agent is a dithiophosphoric acid or phosphorodithioic acid. The dithiophosphoric acid may be represented by the formula $(RO)_2PSSH$ wherein each R is independently a hydrocarbyl group containing from about 3 to about 30, or up to about 18, or to about 12, or to about 8 carbon atoms. Examples R include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl R groups include butylphenyl, amylphenyl, heptylphenyl, etc. Examples of mixtures of R groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the dithiophosphoric acid may be reacted with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols having from 1 to about 12, or about 2 to about 6, or 2 or 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

The phosphorus acid esters are described in U.S. Pat. No. 5,883,057 issued to Roell et al whose disclosure is hereby incorporated by reference.

The following Examples P-1 through P-3 exemplify the preparation of useful phosphorus acid esters.

EXAMPLE P-1

Phosphorus pentoxide (64 grams) is added at 58° C. over a period of 45 minutes to 514 gram s of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and an acid number of 126 (bromophenol blue).

EXAMPLE P-3

Alfol 8-10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there after heated at 70° C. for about 2–3 hours.

The following examples relate to the phosphorus salts of nitrogen containing polymers as used in the present invention.

EXAMPLE A

A reaction vessel is charged with 95 parts of the polymer of Example N-1 and is heated to approximately 60° C., 3.5 parts of the product of Example P-2 is added dropwise with stirring. The addition is accomplished over 30 minutes. The mixture is maintained at 60° C. for approximately 1½ hours to obtain the desired product.

The following table contains additional examples of phosphorus salts of the nitrogen containing polymers. The examples are prepared as described in Example A. The amounts and the ingredients are specified in the table.

| | B | C | D | E | F | G | H | I | J |
|---|---|---|---|---|---|---|---|---|---|
| Polymer of Ex N-1 | — | 95 | — | 96.5 | — | — | — | 98 | — |
| Polymer of Ex N-4 | 94 | — | — | — | — | 96.8 | — | — | — |
| Polymer of Ex N-6 | — | — | 97 | — | 96.8 | — | 96.8 | — | 99 |
| Product of Ex P-2 | — | — | 3 | — | 3.2 | — | — | 2 | — |
| Di-methylpentyl dithiophosphoric acid | — | 5 | — | 1.8 | — | 3.2 | — | — | — |
| Product of Ex P-3 | 6 | — | — | 1.7 | — | — | 3.2 | — | 1 |

Lubricants

As previously indicated, the salts of the nitrogen containing polymers and the phosphorus acid ester are useful in lubricants where they can function primarily as antiwear, dispersant and viscosity modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in natural gas engines, stationary power engines and turbines and the like. Automatic or manual transmission fluids, transaxle lubricants, gear lubricants, both for open and enclosed systems, tractor lubricants, metal-working lubricants, hydraulic fluids and other lubricating oil and grease compositions can also benefit from the incorporation therein of the compositions of the present invention. They may also be used in lubricants for wirerope, walking cam, slideway, rock drill, chain and conveyor belt, worm gear, bearing, and rail and flange applications.

The nitrogen salt of the containing polymers and the phosphorus acid esters may be used in lubricants or in concentrates. The concentrate may contain the sulfurized composition or other components used in preparing fully formulated lubricants. The concentrate also contains a substantially inert organic diluent, which includes kerosene, mineral distillates, or one or more of the oils of lubricating viscosity discussed below. In one embodiment, the concentrates contain from about 0.01% up to about 90%, or from about 0.1% to about 80%, or from about 1% up to about 70% by weight of the sulfurized combination of a fatty acid or ester and an olefin.

The salts of the nitrogen containing polymers and the phosphorus acid esters may be present in a final product, blend, or concentrate in any amount effective in lubricating compositions. Generally the salts are present in the lubricating composition in an amount from about 0.5% up to about 40%, or from about 1% up to about 35%, or from about 2% up to about 30%, or from about 3% up to about 25% by weight.

The lubricating compositions and methods of this invention employ an oil of lubricating viscosity, including natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalphaolefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, or at least about SAE 75. The lubricating composition may also have a so-called multigrade rating such as SAE 75W-80, 75W-90, 75W-90, or 80W-90. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, or polymethacrylate. Viscosity improvers available commercially include Acryloid™ viscosity improvers available from Rohm & Haas; Shellvis™ rubbers available from Shell Chemical; and Lubrizol 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

Other Additives

The invention also contemplates the use of other additives. Such additives include, but are not limited to, detergents and dispersants, corrosion-inhibiting agents, oxidation inhibiting agents, pour point depressing agents, extreme pressure agents, antiwear agents, color stabilizers, anti-foam agents and the like.

The detergents are exemplified by oil-soluble neutral and basic salts (i.e. overbased salts) of alkali, alkaline earth, or transition metals with sulfonic acids, carboxylic acids, including hydrocarbyl substituted carboxylic acylating agents, phenols or organic phosphorus acids. The hydrocarbyl-substituted carboxylic acylating agents include agents which have a hydrocarbyl group derived from a polyalkene, such as polybutene. The phosphorus acids include those prepared by the treatment of a polyalkene with a phosphorizing agent, such as phosphorus pentasulfide. The most commonly used metals are sodium, potassium, lithium, calcium, and magnesium. The term "basic salt" is used to designate metal salts wherein the metal is present in stoichiometrically larger amounts than the organic acid radical. The overbased salts and borated overbased salts are prepared by means known to those in the art.

The lubricants may also include a dispersant. The dispersants are known in the art. The following are illustrative.

(1) "Carboxylic dispersants" are the reaction products of carboxylic acids (or derivatives thereof) containing at least about 34 and or at least about 54 carbon atoms and nitrogen containing compounds (such as amine), organic hydroxy compounds (such as phenols and alcohols), and/or basic inorganic materials. These reaction products include imide, amide, and ester reaction products of carboxylic acylating agents. Examples of these materials include succinimide dispersants and carboxylic ester dispersants.

(2) "Amine dispersants" are the reaction products of relatively high molecular weight aliphatic or alicyclic halides and amines, preferably polalkylene polyamines. These dispersants are described above as polyalkene-substituted amines.

(3) "Mannich dispersants" are the reaction products of alkylphenols and aldehydes (especially formaldehyde) and amines (especially amine condensates and polyalkylenepolyamines).

(4) "Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers.

Auxiliary extreme pressure and/or antiwear agents and corrosion- and oxidation-inhibiting agents may also be included in the lubricating compositions. The auxiliary extreme pressure and/or antiwear agents include sulfur compounds, such as sulfurized olefins and fatty acids or esters, and phosphorus or boron antiwear or extreme pressure agents. The sulfur compounds are present in an amount from about 0.05% or about 0.1% up to about 10%, or from about 1% up to about 7%, or from about 1.5% up to about 5% by weight of the lubricating composition. Typically, the phosphorus or boron containing antiwear or extreme pressure agent is present in the lubricants and functional fluids at a level from about 0.01% up to about 10%, or from about 0.05% up to about 3%, or from about 0.08% up to about 2% by weight.

The sulfur compounds include mono- or polysulfide compositions, or mixtures thereof. In one embodiment, the polysulfides may be a mixture of di-, tri- or tetrasulfide materials, preferably having a majority of trisulfide being preferred. Materials which may be sulfurized include olefins or polyolefins made therefrom, terpenes, or Diels-Alder adducts. Olefins having about 3 to about 30, or 2 to about 16, or up to about 9 carbon atoms are particularly useful. Olefins having from two to about 5 or to about 4 carbon atoms are particularly useful. Isobutene, propylene and their dimers, trimers and tetramers, and mixtures thereof are especially preferred olefins.

Examples of phosphorus or boron containing antiwear or extreme pressure agents include a metal thiophosphate; a phosphoric acid ester or salt thereof; a phosphite; a phosphorus-containing carboxylic acid, ester, ether, or amide; a borated dispersant; an alkali metal borate; a borated overbased compound; a borated fatty amine; a borated phospholipid; and a borate ester. The phosphorus acids and esters are described above.

Phosphorus acid esters may be reacted with an amine or metallic base to form an amine or metal salt. The amine salts of the phosphorus acid esters may be formed from ammonia, or an amine, including monoamines and polyamines. Tertiary aliphatic primary amines are particularly useful.

The metal salts of the phosphorus acid esters are prepared by the reaction of a metal base with the phosphorus acid ester. The metals include the alkali metals, alkaline earth metals, such as calcium or magnesium, and transition metals, such as manganese, copper, and zinc. An example of a useful metal salt is a reaction product of zinc oxide and a phosphoric acid esters prepared by reacting phosphorus pentoxide with iso-octyl alcohol.

In one embodiment, phosphorus or boron containing antiwear or extreme pressure agent is a metal thiophosphate, such as zinc isopropyl methylamyl dithiophosphate, zinc isopropyl isooctyl dithiophosphate, zinc di(cyclohexyl) dithiophosphate, zinc di(isobutyl)dithiophosphate, zinc isobutyl isoamyl dithiophosphate, and zinc isopropyl sec-butyl dithiophosphate.

In another embodiment, the phosphorus or boron antiwear or extreme pressure agent is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, and having from about 2 up to about 40, or from about 4 up to about 24, or up to about 12 carbon atoms. Suitable acids include hexanoic, 2-ethylhexanoic, octanoic, and dodecanoic acids.

In another embodiment, the phosphorus or boron containing antiwear or extreme pressure agent is a phosphite. The phosphite may be a di- or trihydrocarbyl phosphite, independently having from 1 to about 30, or from about 2 to about 18, or up to about 8 carbon atoms in each hydrocarbyl group. Examples of specific hydrocarbyl groups include butyl, hexyl, octyl, oleyl, linoleyl, stearyl, and phenyl. Particularly useful phosphites include dibutyl phosphite, trioleyl phosphite, $C_{12-14}$ phosphite and triphenyl phosphite.

In one embodiment, the phosphorus or boron containing antiwear or extreme pressure agent is a phosphorus containing amide. The phosphorus containing amides are prepared by the reaction of one of the above described phosphorus acids, preferably a dithiophosphoric acid with an unsaturated amide. Examples of unsaturated amides include acrylamide, N,N-methylene bis(acrylamide), methacrylamide, crotonamide, and the like. The reaction product of the phosphorus acid and the unsaturated amide may be further reacted with a linking or a coupling compound, such as formaldehyde or paraformaldehyde.

In one embodiment, the phosphorus or boron antiwear or extreme pressure agent is a phosphorus containing carboxylic ester. The phosphorus containing carboxylic esters are prepared by reaction of one of the above-described phosphorus acids, such as a dithiophosphoric acid, and an unsaturated carboxylic acid or ester. Examples of unsaturated carboxylic acids and anhydrides include acrylic acid, methacrylic acid, itaconic acid, maleic acid, fumaric acid, and maleic anhydride.

The ester may be represented by one of the formulae: $R_6C{=}C(R_7)C(O)OR_8$, or $R_8O{-}(O)C{-}HC{=}CH{-}C(O)OR_8$, wherein each $R_7$ and $R_8$ are independently hydrogen or a hydrocarbyl group having 1 to about 18, or to about 12, or to about 8 carbon atoms, $R_6$ is hydrogen or an alkyl group having from 1 to about 6 carbon atoms. In one embodiment, $R_6$ is hydrogen or a methyl group. Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric and citraconic acids.

In one embodiment, the phosphorus or boron containing antiwear or extreme pressure agent is a reaction product of a phosphorus acid, such as a dithiophosphoric acid, and a vinyl ether. The vinyl ether is represented by the formula $R_9{-}CH_2{=}CH{-}OR_{10}$ wherein $R_9$ is independently hydrogen or a hydrocarbyl group having from 1 up to about 30, or up to about 12 carbon atoms. $R_{10}$ is a hydrocarbyl group defined the same as $R_9$. Examples of vinyl ethers include methyl vinyl ether, propyl vinyl ether, 2-ethylhexyl vinyl ether and the like.

In one embodiment, the phosphorus or boron containing antiwear or extreme pressure agent is a reaction product of a phosphorus acid, such as a dithiophosphoric acid, and a vinyl ester. The vinyl ester may. be represented by the formula $R_{11}CH{=}CH{-}O(O)CR_{12}$, wherein $R_{11}$, is hydrogen, or a hydrocarbyl group having from 1 to about 30, or to about 12 carbon atoms, preferably hydrogen, and $R_{12}$ is a hydrocarbyl group having 1 to about 30, or to about 12, or to about 8 carbon atoms. Examples of vinyl esters include vinyl acetate, vinyl 2-ethylhexanoate, vinyl butanoate, etc.

In another embodiment, the phosphorus or boron containing antiwear or extreme pressure agent is an alkali metal borate. Alkali metal borates are generally a hydrated particulate alkali metal borate which are known in the art. Alkali metal borates include mixed alkali and alkaline earth metal borates. These alkali metal borates are available commercially.

In another embodiment, the phosphorus or boron containing antiwear or extreme pressure agent is a borated overbased compound. Borated overbased compounds are generally prepared by reacting one or more or the above overbased compounds, usually as a carbonated overbased compound with a boron compound, which include boric acid and lower alkyl (e.g. containing less than about 8 carbon atoms) boron esters. The overbased compounds are generally characterized as having a metal ratio from about 5 to about 40, or from about 10 to about 35, or from about 15 to about 30. Examples of borated overbased compounds include borated overbased sodium alkylbenzene sulfonate, borated overbased polybutenyl ($\overline{M}$ n=950) substituted succinate, and borated overbased magnesium alkylbenzene sulfonate.

In another embodiment, the phosphorus or boron antiwear or extreme pressure agent is a borated fatty amine. The borated amines are prepared by reacting one or more of boron compounds, with a fatty amine, e.g. an amine having from about four to about eighteen carbon atoms. The borated fatty amines are prepared by reacting the amine with the boron compound at a temperature from about 50° C. to about 300° C., or from about 100° C. to about 250° C., and at an amine to boron compound equivalent ratio of 3:1 to 1:3.

In another embodiment, the phosphorus or boron containing antiwear or extreme pressure agent is a borated epoxide. The borated fatty epoxides are generally the reaction product of one or more boron compounds, with at least one epoxide, generally having at least 8 carbon atoms.

In another embodiment, the phosphorus or boron containing antiwear or extreme pressure agent is a borated phospholipid. The borated phospholipids are prepared by reacting a combination of one or more phospholipid and one or more boron compound. Phospholipids, sometimes referred to as phosphatides and phospholipins, are lipids which contain a phosphoric acid or derivative thereof.

Other antiwear and extreme pressure agents include chlorinated aliphatic hydrocarbons, such as chlorinated wax; sulfurized alkylphenols; phosphosulfurized hydrocarbons, such as the reaction product of a phosphorus sulfide with turpentine or methyl oleate; metal thiocarbamates, such as zinc dioctyldithiocarbamate, or barium diheptylphenyl dithiocarbamate; dithiocarbamate esters, such as reaction products of an amine (e.g., butylamine), carbon disulfide, and one or more of the above unsaturated amide, ester, acid, or ether, such as acrylic, methacrylic, maleic, or fumaric acids, esters, or salts and acrylamides; and dithiocarbamates, such as alkylene coupled dithiocarbamates, which include methylene or phenylene coupled bis (butyldithiocarbamates), and bis-(s-alkyldithiocarbamoyl) disulfides, which are known and referred to as sulfur-coupled thiocarbamates. Many of the above-mentioned extreme pressure agents and corrosion- and oxidation-inhibitors also serve as antiwear agents.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers.

Antifoam agents are used to reduce or prevent the formation of stable foam. Typical antifoam agents include silicones or organic polymers

EXAMPLES 1–10

Lubricating oil compositions are prepared by blending into a mineral oil basestock 1.41% of the reaction product of a polyisobutenyl (Mn about 1700) substituted succinic anhydride and ethylene polyamine, 0.47% of sulfurized Diels-Alder adduct of butadiene and butyl acrylate, 0.81% of a zinc salt of mixed primary dialkyl dithiophosphoric acids, 0.78% of calcium overbased (metal ratio 12) alkyl benzene sulfonic acid and 3.3% of each of the products of Examples A–J.

EXAMPLES 11–20

Gear lubricant compositions are prepared by mixing 26% (parts by weight) each of the Products of Examples A–J, with 0.8 part of a styrene-maleate ester-methyl methacrylate copolymer, and 6.5 parts of a commercially available gear additive package known as Anglamol™ 99 available from The Lubrizol Corporation to provide 100 parts of lubricating oil composition.

EXAMPLES 21–30

A gear lubricant composition is prepared by mixing the 29% (parts by weight) each of the products of Examples 1–10, and 10 parts of a commercially available gear additive package known as Anglamol™ 2000 available from The Lubrizol Corporation to provide 100 parts of lubricating oil composition.

EXAMPLES 31–40

Automatic transmission fluid compositions is prepared by mixing 11.8 parts by weight each of the Products of Example A–J with 1.5 parts polyisobutene (Mn=1000) substituted succinic anhydride-polyethylene polyamine reaction product, 0.15 part dibutyl hydrogen phosphite, 0.25 part boronated polyisobutene (Mn=1000) substituted succinic anhydride-polyethylene polyamine reaction product, 0.2 part boronated $C_{16}$ epoxide, 0.63 part di-(nonylphenyl) amine, 0.5 part propylene oxidelt-dodecyl mercaptan reaction product, 0.05 part ethoxylated N-fatty propane diamine, 0.1 part ethoxylated oleyl imidazoline, 0.6 part sulfolene-decyl alcohol reaction product, 0.03 part tolyl triazole, 0.2 part calcium overbased (metal ratio=1.2) alkyl benzene sulfonate, 0.025 part red dye, and 0.04 part silicone antifoam agent in a mineral oil basestock to prepare 100 parts of lubricant.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A lubricating composition comprising a major amount of an oil of lubricating viscosity and a minor amount of a salt of a phosphorus acid ester and a nitrogen containing polyacrylate wherein the poylacrylate is prepared from a combination of: a) methacrylic acid esters containing from 9 to 25 carbon atoms in the ester group, b) methacrylic acid esters containing 7 to 12 carbon atoms in the ester group and c) at least one nitrogen containing monomer wherein the nitrogen containing monomer is a vinyl hetrocyclic monomer selected from the group comprising a vinyl pyridine, vinyl imidazoline, vinyl pyrrolidinone, vinyl caprolactam or mixtures thereof.

2. The composition of claim 1 wherein the polyacrylate has a weight average molecular weight from about 10,000 to about 350,000.

3. The composition of claim 1 wherein the nitrogen containing polyacrylate is prepared from at least one acrylate or methacrylate ester and a nitrogen containing monomer.

4. The composition of claim 3 wherein the acrylate or methacrylate ester has from about 2 to about 30 carbon atoms.

5. The composition of claim 1 wherein the phosphorus acid ester is a dihydrocarbyl phosphoric acid ester having from 6 to 24 carbon atoms in each hydrocarbyl group.

6. The composition of claim 1 wherein the phosphoric acid ester is a dihydrocarbyl dithiophosphoric acid independently having from 1 to 24 carbon atoms in each hydrocarbyl group.

7. The composition of claim 1 wherein the phosphoric acid ester is a phosphoric acid ester prepared by reacting a dithiophosphoric acid with an epoxide to form an intermediate and the intermediate is further reacted with a phosphorus acid or anhydride.

8. The composition of claim 1 wherein the phosphoric acid ester is a thiophosphoric acid ester.

9. The composition of claim 1 wherein the lubricating composition is a crank case lubricant.

10. The composition of claim 1 wherein the lubricating composition is a gear oil.

* * * * *